US006289833B1

(12) United States Patent
Kirk

(10) Patent No.: US 6,289,833 B1
(45) Date of Patent: Sep. 18, 2001

(54) DEVICE FOR MOVING AN INDIVIDUAL RELATIVE TO A SURFACE WITH THE ASSISTANCE OF WIND

(76) Inventor: Gerry Kirk, 304 Pacific Ave., Solana Beach, CA (US) 92075

( * ) Notice: Subject to any disclaimer, the term of this patent is extended or adjusted under 35 U.S.C. 154(b) by 0 days.

(21) Appl. No.: 09/697,783

(22) Filed: Oct. 26, 2000

(51) Int. Cl.[7] ..... B63H 11/00

(52) U.S. Cl. ..... 114/39.21; 114/39.22; 441/129

(58) Field of Search ..... 114/39.11, 34.22, 114/34.25, 34.29, 34.21; 441/65, 129; 280/810

(56) References Cited

U.S. PATENT DOCUMENTS

| | | | |
|---|---|---|---|
| 2,735,115 | 2/1956 | Dees . | |
| 2,735,690 | 2/1956 | Paden . | |
| 3,123,373 | 3/1964 | Antcliff . | |
| 3,140,878 | 7/1964 | Davis . | |
| 3,307,209 | 3/1967 | Jackman . | |
| 3,319,972 | 5/1967 | Gallaher . | |
| 3,432,182 | 3/1969 | Solipasso . | |
| 3,435,471 | 4/1969 | Drennen . | |
| 3,455,261 | 7/1969 | Perrin . | |
| 3,768,823 | 10/1973 | Goldberg . | |
| 4,389,961 | 6/1983 | Parish . | |
| 4,395,241 | 7/1983 | Comparetto . | |
| 4,413,832 | 11/1983 | Pendleton . | |
| 4,466,372 | 8/1984 | Rudloff . | |
| 4,533,159 | 8/1985 | Seidel . | |
| 4,831,950 * | 5/1989 | Allured | 280/810 |
| 5,114,370 | 5/1992 | Moran . | |
| 5,401,048 | 3/1995 | Hopkins . | |
| 5,704,305 | 1/1998 | Winter . | |
| 5,979,351 | 11/1999 | Fleischman . | |

* cited by examiner

*Primary Examiner*—Jesus D. Sotelo
(74) *Attorney, Agent, or Firm*—James P. Broder; Steven G. Roeder

(57) ABSTRACT

A device (10) for moving an individual (12) over a surface (14) with the assistance of wind (16) is provided herein. The device (10) includes a support section (18), and a sail section (20) which is pivotally fixed to the support section (18). The sail section (20) catches wind (16) to move the support section (18) and the individual (12) relative to the surface (14) The sections (18, 20) are made from a resiliently deformable material, and may be inflatable, non-inflatable, or a combination of both. The device (10) can also include one or more rudders (66) secured to the support section (18) for steering the device (10). Further, the device (10) can include one or more skegs (76) secured to the support section (18) to guide movement of the device (10). The sail section (20) preferably includes a sail controller (40) for directionally catching wind (16) to steer the device (10). Moreover, the sail section (20) can include one or more substantially transparent view ports (38) to allow the individual (12) to see through the sail section (20) to navigate the device (10). The device (10) is specifically designed to be safe and easy to use from numerous positions.

31 Claims, 7 Drawing Sheets

18
22
24
34
30

18
30
66
28
3
32
42
40
30
54
4
3
20
38
34
26
40

54
48
54
34
20
34

FIG. 5
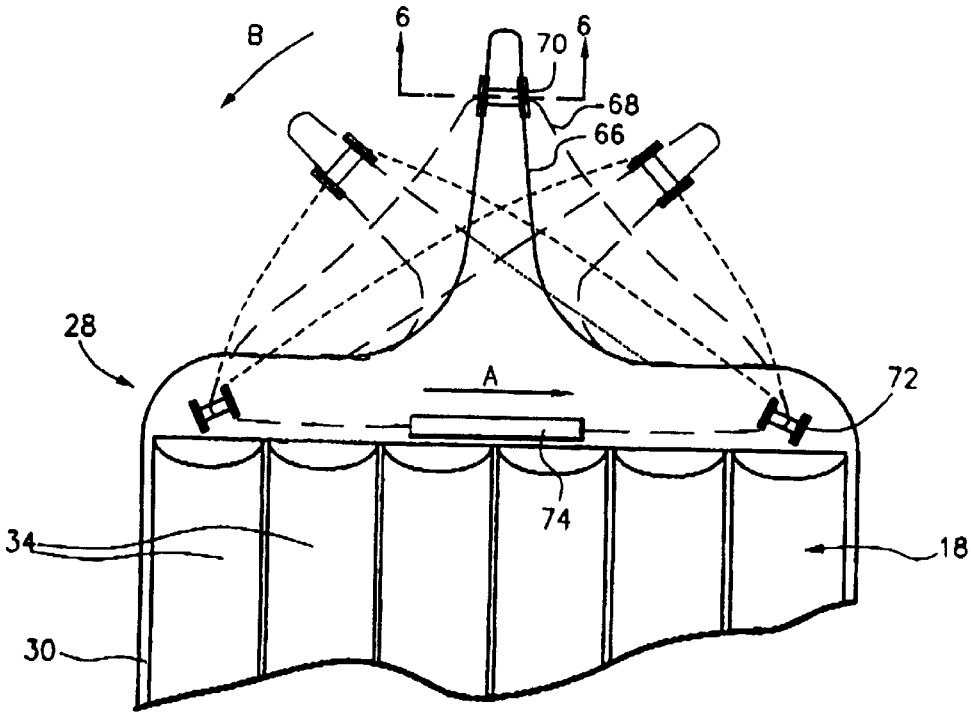
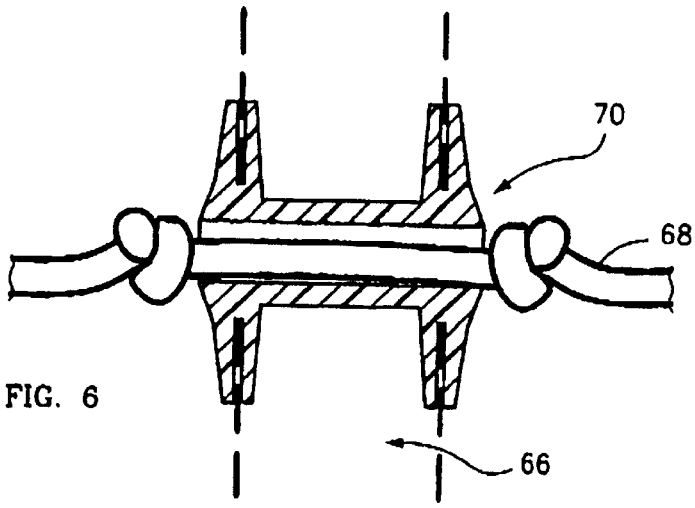
FIG. 6
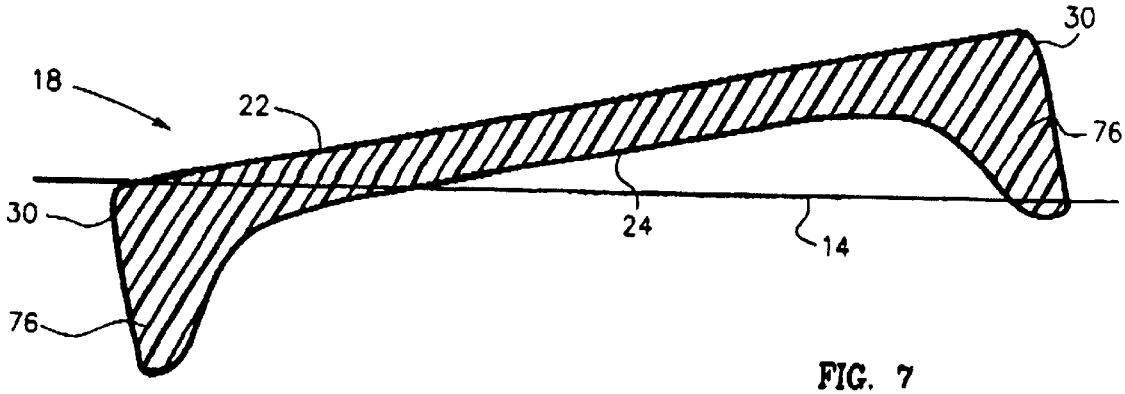
FIG. 7

DEVICE FOR MOVING AN INDIVIDUAL RELATIVE TO A SURFACE WITH THE ASSISTANCE OF WIND

FIELD OF THE INVENTION

The present invention relates generally to a device for moving individuals on water, snow and ice with the assistance of wind.

BACKGROUND

People have long enjoyed the use of recreational watercraft such as surfboards, windsurfers, and bodyboards. Likewise, devices for use on snow and ice have become increasingly popular in recent years.

Such devices have historically been somewhat difficult to transport due to their cumbersome configurations, lack of compact size and because of excessive weight. Additionally, the ability to use many such devices depends on water currents, wave activity, a motorized device or gravity for forward motion over a given surface, thereby limiting the locations and conditions allowing such usage. Further, such devices have become increasingly complex making them more difficult to learn to use quickly, leading to added frustration by the user. Moreover, some recreational devices are tricky to control, and may therefore be too dangerous for young or inexperienced riders, resulting in an increased risk of injury.

In light of the above, it is an object of the present invention to provide a device for moving individuals on water, snow and ice with the assistance of wind that is safety-oriented and easy to use by persons of all ages. It is a further object of the present invention to provide a recreational device that is lightweight, inexpensive and easy to assemble.

SUMMARY

The present invention is directed to a device for moving an individual over a surface with the assistance of wind. The device includes a support section and a sail section. The support section is sized and shaped to support the individual. The sail section is pivotally fixed to the support section. The sail section catches the wind to move the support section and the individual relative to the surface. As provided in detail below, because the device is constructed of lightweight material, and can be used while standing, kneeling, sitting or in the prone position, it is particularly easy to operate. Further, because the sail section and the support section comprise a substantially continuous one-piece, flexible structure, the device can safely be used by persons of all ages. Further, the device is relatively inexpensive, and requires little or no assembly.

The support section is designed to be sufficiently buoyant to support one or more individuals when in use in a liquid medium such as water. As provided herein, the support section can be made of a flexible memory foam and/or it can include one or more inflatable chambers.

The sail section preferably includes one or more substantially transparent view ports to allow the user to see through the sail section in order to navigate the device. The sail section also typically includes a sail controller that allows the individual to control the direction of the sail section relative to the wind in order to steer the device. Moreover, the sail section may include one or more sail stiffeners that are oriented substantially parallel to a longitudinal axis of the sail section. Each sail stiffener provides increased rigidity to the sail section while the device is in use. Uniquely, because the user may release the sail controller at any time to lower the sail and quickly bring the device to a stop, the device is extremely safe to use.

Further, the device preferably includes a rudder and a rudder controller. The rudder is secured to the support section. The rudder controller is coupled to the rudder. The rudder controller is moved side to side by the user to steer the device. Additionally, the device can include one or more skegs. The skegs extend generally downward from the support section and are oriented substantially parallel with a longitudinal axis of the support section. The skegs stabilize the device and guide movement of the support section over the surface.

The device can be constructed such that the support section and the sail section are comprised of a substantially continuous, one-piece structure, rather than two separate and distinct sections. For example, the sections may be constructed from a single piece of memory foam. Alternatively, the support section and the sail section may be manufactured from materials that are permanently affixed to one another to substantially form a single continuous, unitary structure.

To operate the device, the user is positioned on the support section while the device rests on the surface over which the device is to be used. Next, the user pulls the sail controller toward him/her to raise the sail section from the surface thereby filling the sail section with wind. If the appropriate velocity of wind is present, the device then begins to move across the surface. The user may change direction of the device by adjusting the position of the sail with the sail controller, adjusting the position of the rudder with the rudder controller, or a combination both. The device is brought to a stop by releasing the sail controller to lower the sail section back down to the surface.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which:

FIG. 5 is a top view of an embodiment of a rudder and a rudder controller, with movement of the rudder (shown in phantom), and a portion of a support section having features of the present invention;

FIG. 6 is a cross-sectional view taken on line 6—6 of FIG. 5;

FIG. 7 is a rear view of a first embodiment of two skegs extending generally downwardly from the support section during a left turn of the device;

DESCRIPTION

Figure 1:
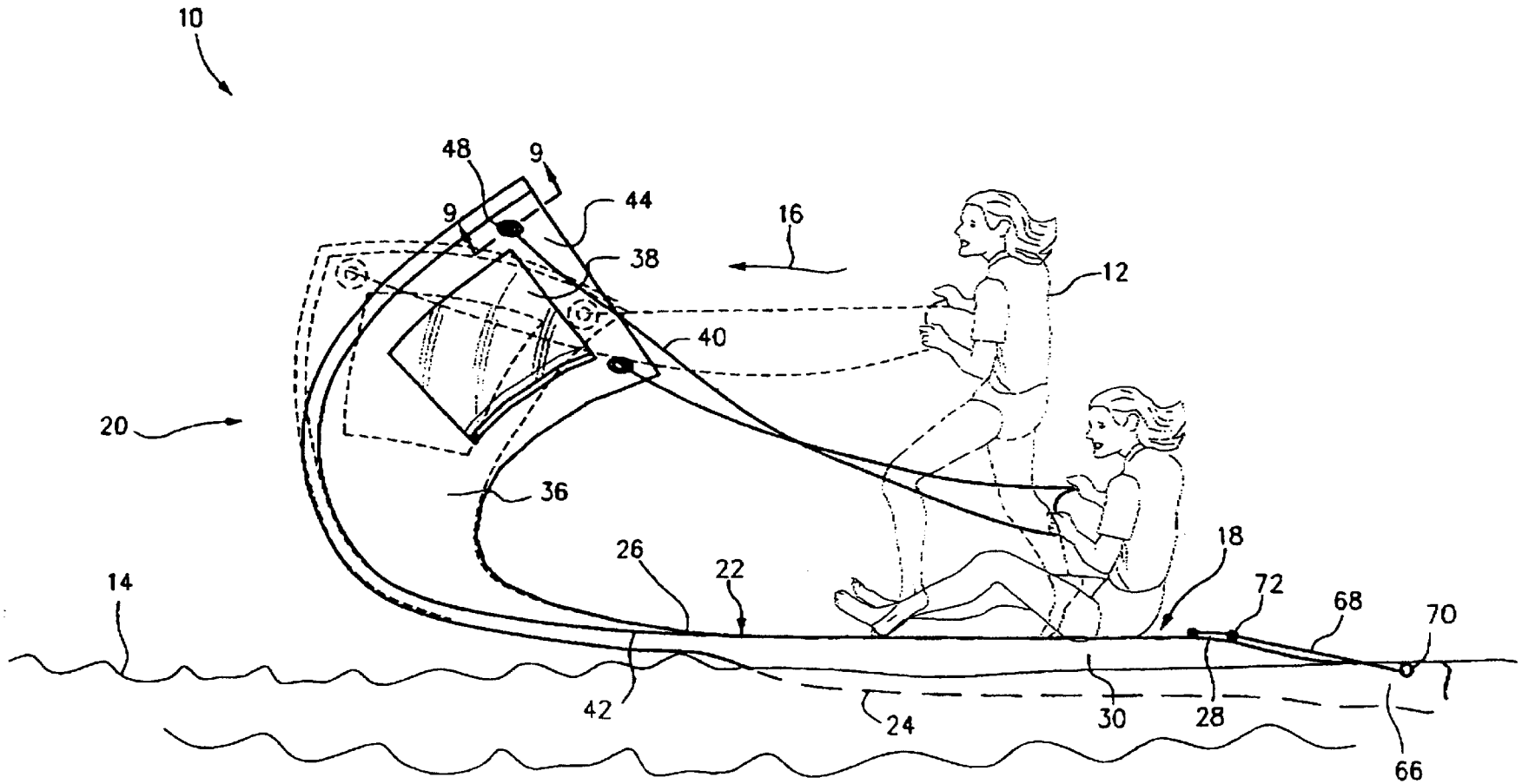
FIG. 1 is a perspective view of a first embodiment of a device having the features of present invention.
Figures 2, 3, 4:
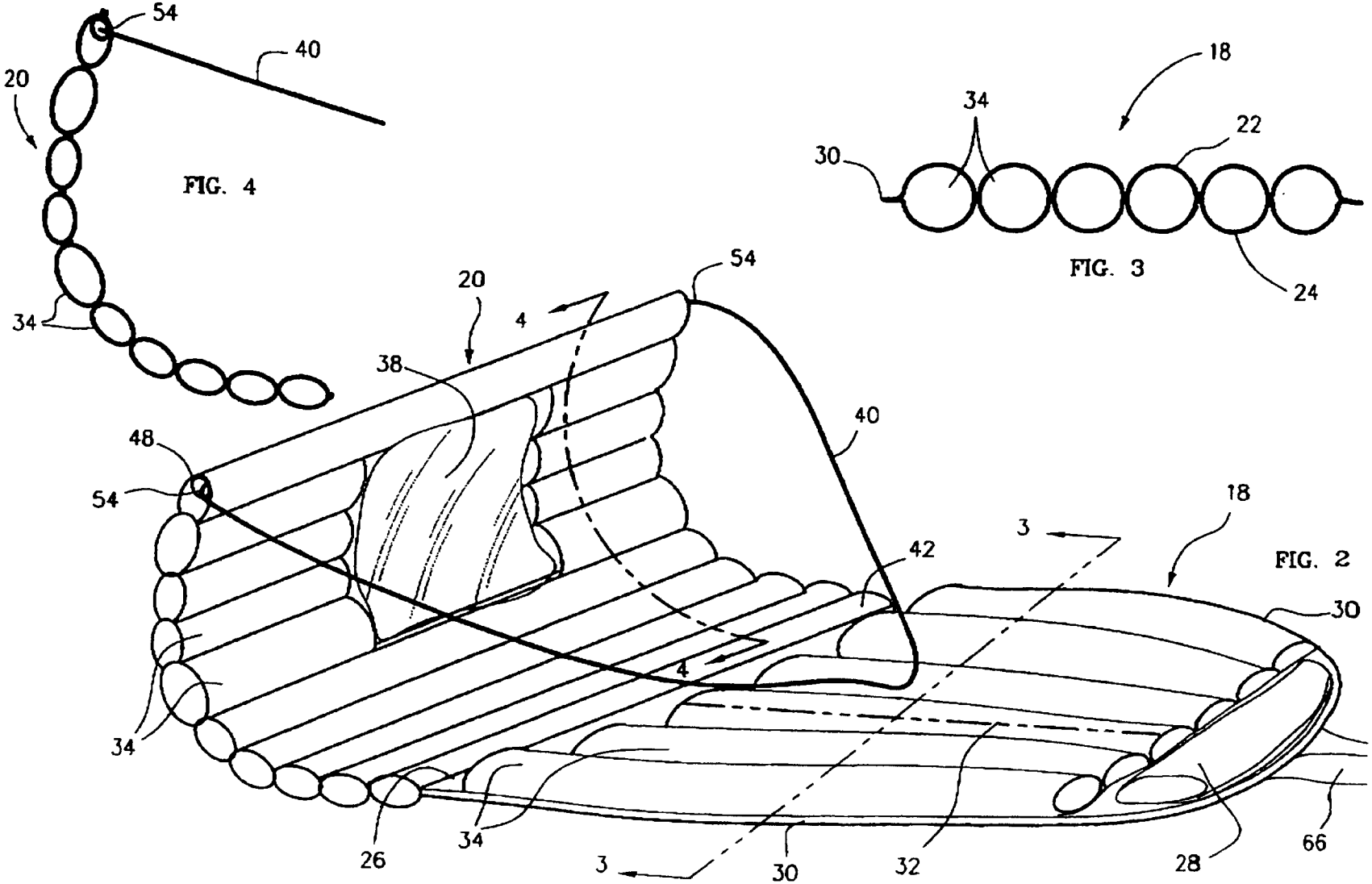
FIG. 2 is a perspective view of a second embodiment of a device having the features of present invention.
FIG. 3 is a cross-sectional view taken on line 3—3 of FIG. 2.
FIG. 4 is a cross-sectional view taken of line 4—4 of FIG. 2.

Referring initially to FIGS. 1 and 2, the present invention is directed to a device 10 for moving an individual 12 across a surface 14 with the assistance of wind 16 (illustrated in some of the Figures). The device includes a support section 18 and a sail section 20 that is pivotally attached to the support section 18. The sections 18, 20 may be separate and distinct sections connected to one another. Alternatively, the sections 18, 20 may be formed from as a substantially continuous, one-piece structure. The sections may be substantially formed as a single piece of material, or the sections 18, 20 may be two distinct sections that are permanently fixed to one another.

The support section 18 supports the individual 12 during movement of the device 10 over the surface 14. As shown in FIGS. 1, 2, 7 and 10–13, the support section 18 is generally rectangular in shape, and is defined by a support top 22, a support bottom 24, a front support edge 26, a rear support edge 28, and two side support edges 30. The user 12 is generally oriented on the support top 22 while the device 10 is in use. The support top 22 is substantially parallel to the surface 14 over which the device 10 moves while the device 10 is in use. The support bottom 24 is generally parallel to the support top 22. Further, the support bottom 24 is substantially in contact with the surface 14 over which the device 10 is being used, such as water, ice or snow.

The front support edge 26 typically forms the connection of the support section 18 to the sail section 20. The rear support edge 28 is located at an end of the support section 18 opposite the front support edge 26. The rear support edge 28 can be relatively linear and generally perpendicular to a longitudinal axis 32 of the support section 18. Alternatively, the rear support edge 28 may, for example, be generally arcuate or rounded in shape for increased maneuverability of the device 10. The lengths of the front and rear support edges 26, 28 are generally similar on a given device 10. The lengths may vary from device 10 to device 10, however, and may range from approximately two to six feet (2'–6').

The side support edges 30 run generally parallel with the longitudinal axis of the support section 32. The length of the side support edges 30 can vary from about three to eight feet (3'–8'), although the lengths of each side support edge 30 on a given device 10 are typically substantially similar.

As further illustrated in the figures, the overall size and thickness of the support section 18 may vary depending upon the needs of the user 12. First, a larger individual 12 will require a greater degree of buoyancy, and thus the individual 12 will need either a larger support section 18 area or a greater thickness of the support section 18. For instance, a full size adult would typically need a larger and/or thicker support section 18 than that of a child. Second, the device 10 may be designed as a single-user device, or a multiple-user device 10. The more individuals 12 riding the device 10, the larger area and/or greater thickness the support section 18 needs to be. Third, a device 10 used for attaining higher speeds would be better suited to having a reduced surface area of the support section 18 to reduce friction between the device 10 and the surface 14 over which the device 10 is moving.

As depicted in the embodiment of FIG. 1, the support section 18 can be constructed from a resiliently deformable closed-cell foam or plastic material such as polyurethane or polystyrene, as examples. The support section 18 can also be made from an inflatable flexible fabric material such as polyurethane rubber or other suitable inflatable materials. The support section 18 can include one or more inflatable chambers 34 for buoyancy in a liquid surface 14, as shown in the embodiment of FIGS. 2 and 3. Alternatively, the support section 18 may include a combination of closed-cell foam materials and inflatable fabric materials.

In the embodiments utilizing a support section 18 made from closed-cell foam or plastic materials, the support section 18 can also include one or more generally planar spaced-apart laminations (not shown). The laminations are oriented parallel to the support top 22. The laminations are made from high-density material such as nylon or an equivalent material, and provide increased strength to prevent tears or perforations in the support section 18. Typically, the laminations are bonded to the closed-cell foam or plastic material of the support section 18 by a thermo lamination process or another suitable method to provide a strong bond between the lamination material and the foam or plastic material of the support section 18.

Preferably, the support section 18 provides sufficient buoyancy in a liquid surface 14 such that the user 12 may stand, kneel, sit or lay on the support section 18 during operation of the device 10. Because of the device's 10 versatility in allowing the user 12 to operate the device 10 in a variety of positions, the device 10 accommodates users 12 of all ages.

The sail section 20 catches the wind 16 to move the device 10 along the surface 14, the sail section 20 illustrated in FIG. 1 includes a sail portion 36, a substantially transparent view port 38, and one or more sail controllers 40. The sail portion 36 can be formed from a resiliently deformable closed-cell foam or plastic material such as polyurethane or polystyrene, as examples. The sail portion 36 can also be made from a flexible fabric material such as polyurethane rubber, nylon, or another suitable flexible fabric material capable of catching wind 16. Alternatively, the sail portion 36 may include a combination of resiliently deformable closed-cell foam materials and fabric materials.

Figure 11:
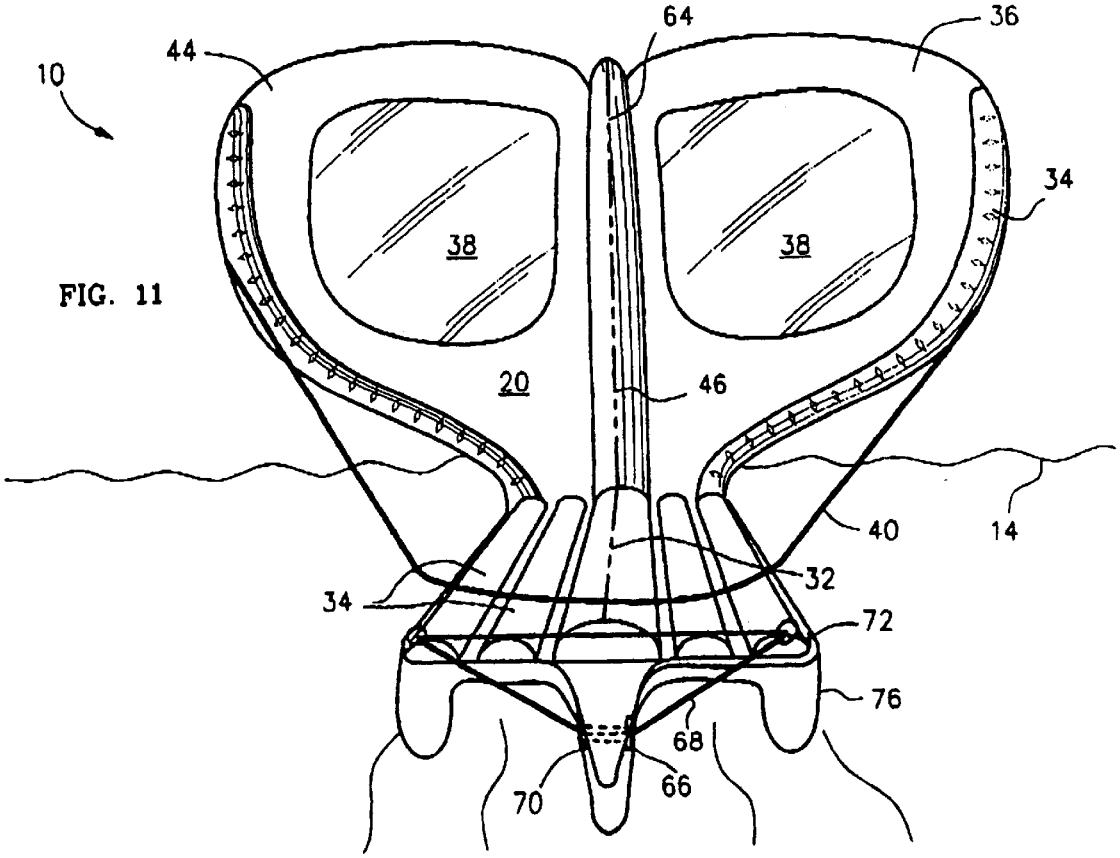
FIG. 11 is a perspective view of a fourth embodiment of the device having the features of the present invention.

The sail portion 36 includes a proximal sail region 42 and a distal sail region 44. The proximal sail region 42 is typically connected to the front support edge 26 of the support section 18. The length of the proximal sail region 42, as measured on a line perpendicular to a longitudinal axis 46 of the sail section 20, ranges from two to six feet (2'–6'), and approximates that of the front support edge 26. The distal sail region 44 is located opposite the proximal sail region 42 relative to a longitudinal axis 46 of the sail section 20. The distal sail region 44 preferably includes houses one or more sail control guides 48, as discussed below. As illustrated in FIG. 2, the distal sail region 44 can be approximately the same length, as measured on a line perpendicular to the longitudinal axis 46 of the sail section 20, as the proximal sail region 42. Alternatively, as shown in FIG. 11, the length of the distal sail region 44 can be substantially greater than that of the proximal sail region 42, and may range from four to thirty feet (4'–30') in length. The typical distance between the proximal sail region 42 and the distal sail region 44, as measured along the longitudinal axis 46 of the sail section 20, ranges from four to twelve feet (4'–12').

Generally speaking, the larger the sail section 20, the faster the device 10 will move over a surface 14. Therefore, the sail section 20 can have a relatively small surface area, for use by children or less experienced users 12, or in a high-wind area. On the other hand, the sail section 20 may be relatively large, for use in low-wind areas or for experienced users 12.

Because of the properties of the materials from which the device 10 is constructed, the device 10 is extremely compact. The device 10 is capable of being rolled up and used while backpacking, camping, boating or performing other recreational activities. Moreover, the device 10 can be easily transported in the trunk of a vehicle (not shown) because of the flexible construction of the device 10. Additionally, because of the inherent buoyancy qualities of the device 10, it may be used as a floatation device 10 for water emergencies on oceans, lakes, rivers or other bodies of water. Because of the resiliency of the materials used in construction of the device 10, very little, if any, assembly is required. The device 10 will assume its resting position upon being unrolled from storage.

Figure 10:
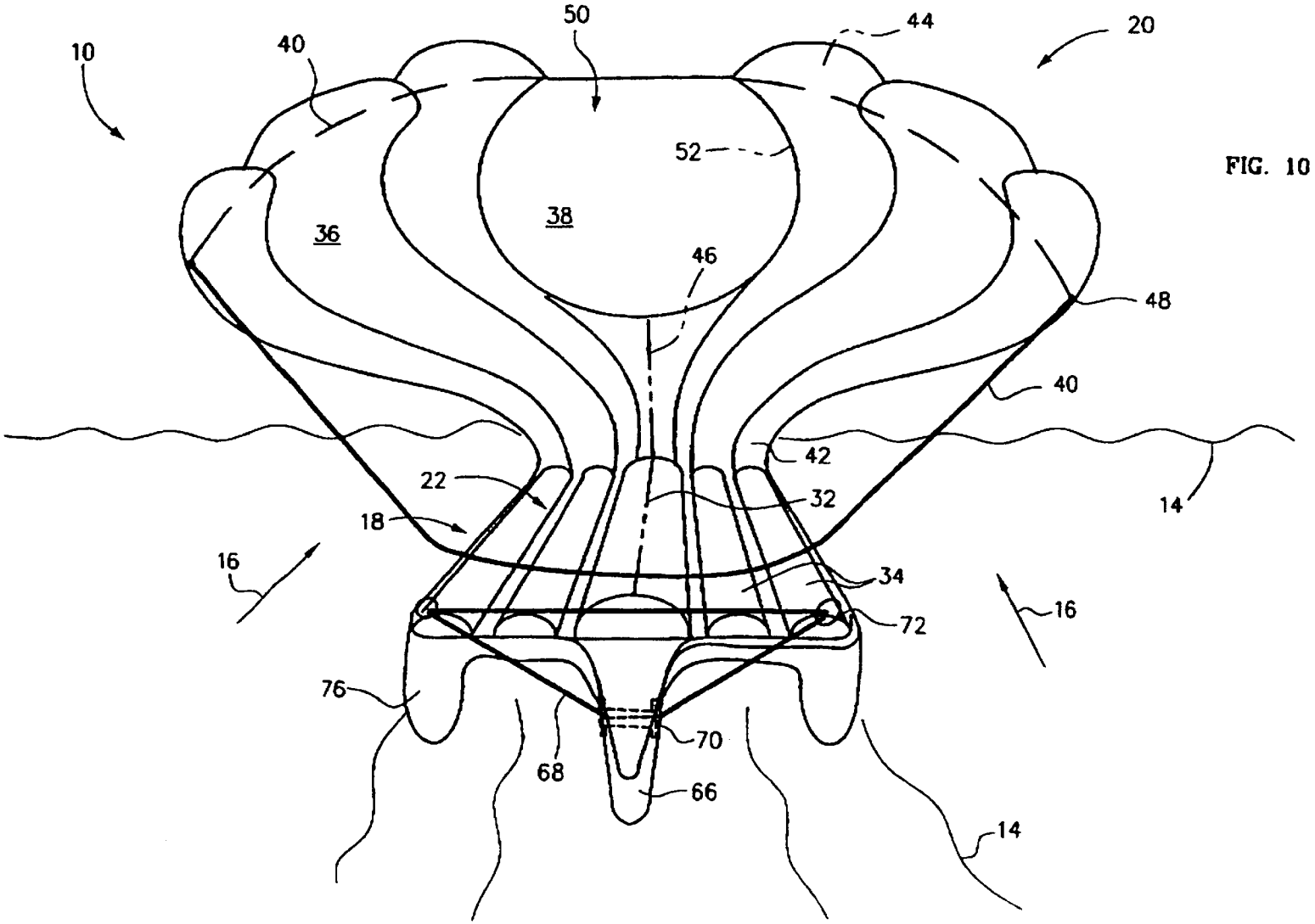
FIG. 10 is a perspective rear view of a third embodiment of the device having features of the present invention.

Referring to FIGS. 1 and 2, the view port 38 allows the individual 12 to see through the sail section 20 to navigate the device 10 while the sail section 20 is in the raised position. In an alternate embodiment, the sail section 20 can include a plurality of view ports 38, for example, as shown in FIG. 11. The view ports 38 may be made from a transparent plastic material or other substantially transparent material. Alternatively, the view port 38 may be in the form of a sail aperture 50 in the sail section 20, as depicted in FIG. 10. The sail portion 36 of this embodiment forms a semicircular frame 52, which in conjunction with a sail controller 40 (shown partially in phantom, discussed below), defines a view port 38 through which the user 12 may see in order to navigate the device 10 while the sail section 20 is in the raised position.

The sail controller 40 is used to steer the device 10. Typically, the sail controller 40 is made from rope, nylon cord, or another sufficiently strong, relatively inelastic material, for responsive movement of the sail section 20 by the user 12. The sail controller 40 may be formed as a continuous loop that traverses the length of the distal sail region 44 and is able to be held by the user 12, as in FIG. 10. In this embodiment, the sail controller 40 defines a portion of the sail aperture 50. Further, the sail controller 40 can also be used to secure the device 10 by tying the device 10 up in a rolled-up, storage position (not shown).

The sail controller 40 may also have one or more controller ends 54, each end 54 being respectively attached to a sail control guide 48 located on the sail portion 36, as depicted in FIGS. 1, 2 and 11. The sail control guide 48 couples the sail controller 40 to the sail portion 36 in one or more locations, preferably at the distal sail region 44.

FIGS. 1, 2 and 10–12 show embodiments of the device 10 wherein the sail controller 40 is coupled to the distal sail region 44 in two locations. The sail control guide 48 is typically a grommet formed from a relatively rigid urethane plastic or epoxy material.

Further, the sail control guide 48 can be heat-attached to the sail portion 36, or by other means of providing an adequate attachment. The sail control guide 48 is normally circular or elliptical in shape, with a typical outside diameter of between one and four inches (1"–4"), and an inside diameter of between one-quarter inch and one inch (¼"–1").

Figure 9:
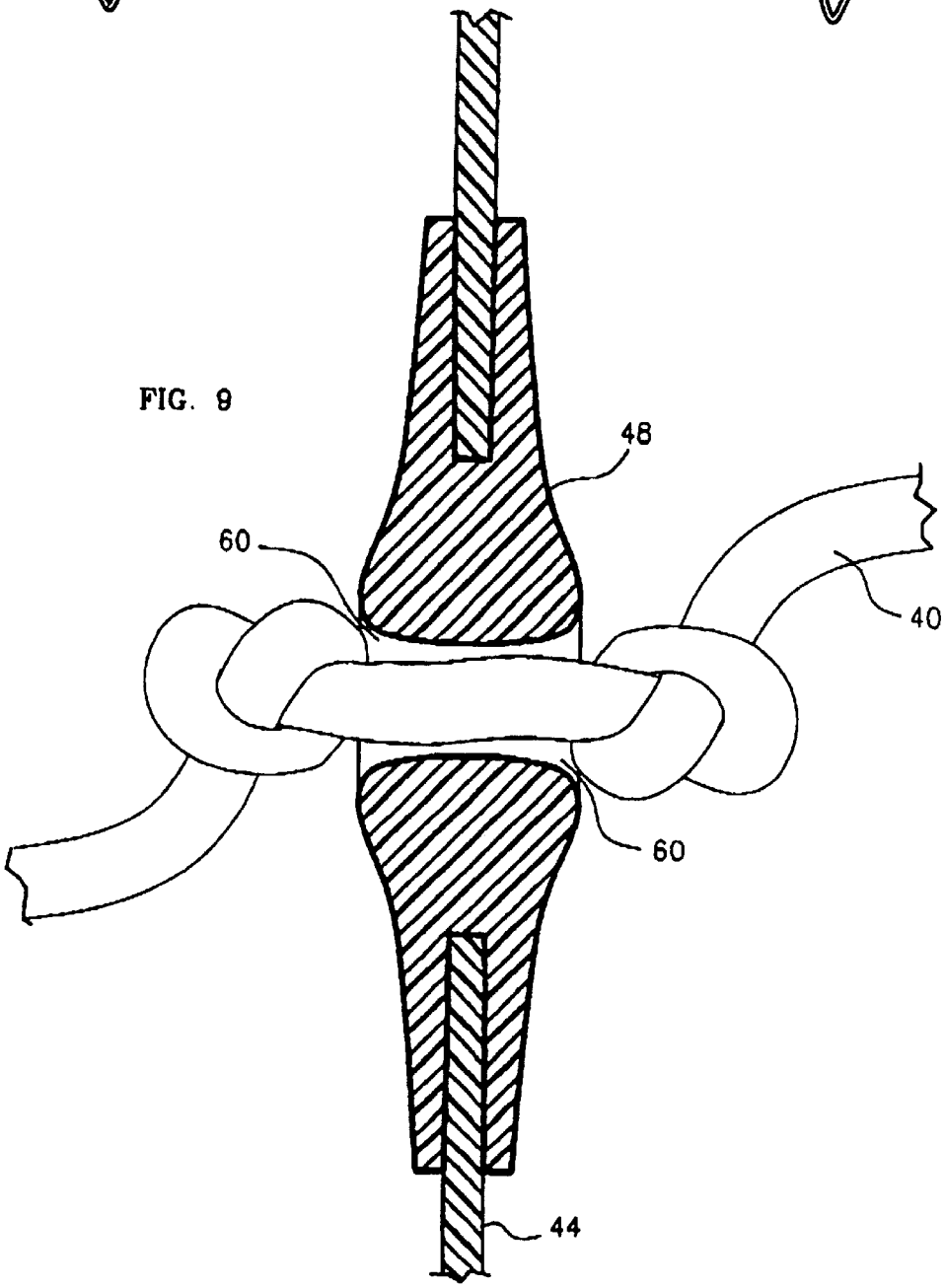
FIG. 9 is a cross-sectional view taken on line 9—9 of FIG. 1.

FIG. 9 illustrates a cross-section of the sail control guide 48 coupled to the sail controller 40 for the device 10 shown in FIG. 1. The sail control guide 48 includes a sail control guide aperture 60 through which the sail control guide 48 is fitted. In this embodiment, the sail controller 40 extends through the sail control guide 48, with the sail controller 40 being knotted on each side of the sail control guide 48 to secure the sail controller 40 to the sail portion 36 of the sail section 20. The sail controller 40 may alternatively be heat-attached to the sail portion 36, or may also be attached by being woven or stitched into the sail portion 36.

The sail controller 40 can also include a sail control handle (not shown) to make the sail controller 40 easier to grasp for the user 12. In addition, the sail controller 40 may also include a device tether 62 or a device leash 62, which hangs loose from the sail controller 40. The tether 62 or leash 62 allows the user 12 to keep the device 10 in close proximity should the user 12 fall off the device 10.

To use the sail controller 40 to directionally steer the device 10, the individual 12 pulls and/or releases the sail controller 40 to turn sail portion 36 for catching wind 16 from the desired direction. Many of the conventional principles of sailing apply herein with respect to orienting the sail portion 36 relative to the wind direction, which is performed by utilizing the sail controller 40. Additionally, raising and/or lowering the sail portion 36 with the sail controller 40 controls the speed of the device 10.

Figure 12:
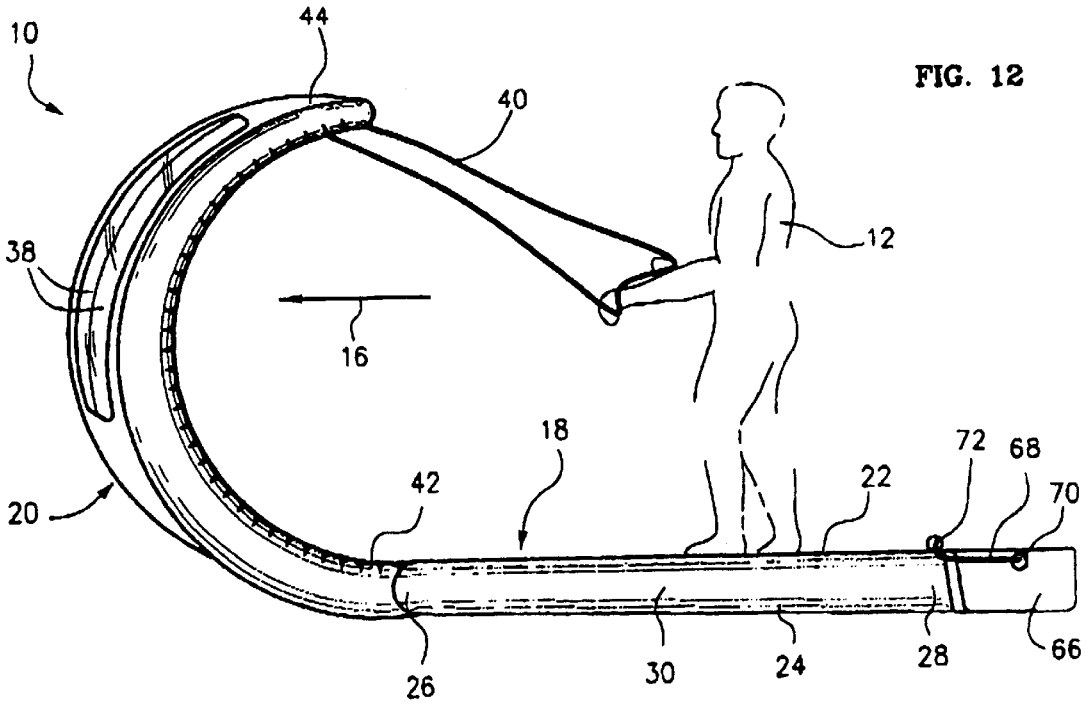
FIG. 12 is a side view of the device shown in FIG. 11 with the sail section in the raised position.
Figure 13:
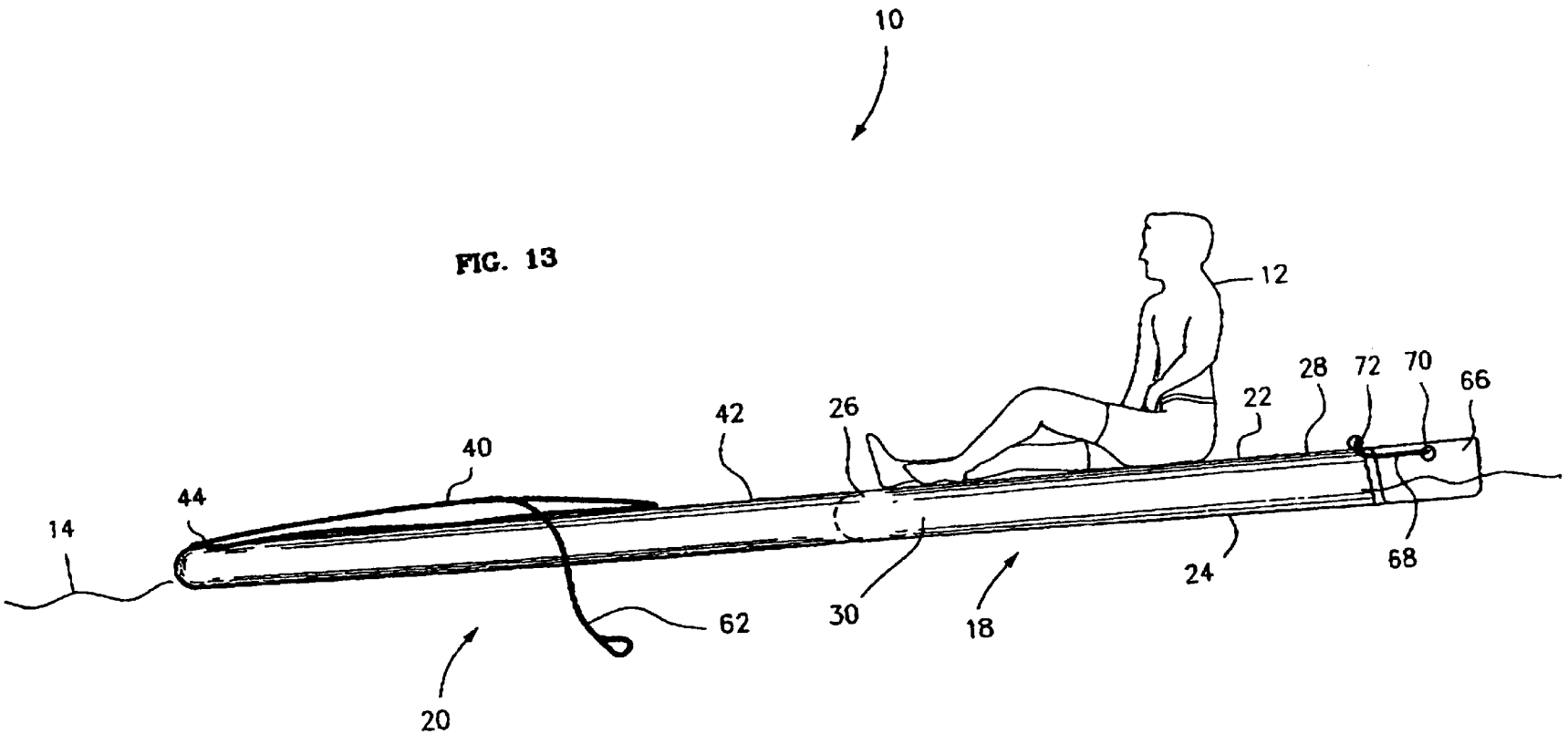
FIG. 13 is a side view of the device shown in FIG. 11 with the sail section in the resting position.

The resilient materials used to form the sail section 20 provide safety for the user 12 when the device 10 is used on a liquid surface 14 or on a flat frozen surface 14. Referring to FIGS. 12 and 13, when the device 10 is in the resting position, e.g. when the sail controller 40 is released to the point of allowing the sail controller 40 to become slack, the sail section 20 automatically returns to its "default" position and lays substantially flat on the surface 14. In this resting position, the sail section 20 is not catching wind 16. Thus, movement of the device 10 is substantially halted when the device 10 is in the resting position. This is particularly useful should the user 12 fall from the device 10, or should the user 12 need to abruptly stop the device 10. In order to bring the sail section 20 into the raised position, the user 12 must pull the sail controller 40 taut to allow the wind 16 to fill the sail section 20, thereby propelling the device 10 across the surface 14.

As illustrated in FIGS. 2, 4 and 11, the sail section 20 can include one or more inflatable chambers 34. FIG. 2 shows a plurality of inflatable chambers 34 oriented generally perpendicular to a longitudinal axis 46 of the sail section 20, depicted as line 4—4. FIG. 11 depicts still another embodiment of the sail section 20 that includes a sail stiffener 64 and two inflatable chambers 34. The sail stiffener 64 is typically oriented parallel to the longitudinal axis 46 of the sail section 20. Further, the sail stiffener 64 can be inflatable as shown in FIG. 11, or it can be non-inflatable and formed from a resiliently deformable closed-cell foam material.

Referring to FIGS. 1, 2 and 10–13, the device 10 may also include one or more rudders 66 and a rudder controller 68 adapted to be moved by the individual 12 to steer the device 10. The rudder 66 is characteristically attached to the rear support edge 28 of the support section 18, and depends generally downward from the support bottom 24, forming roughly a 90-degree angle between the rudder 66 and the support bottom 24. The rudder 66 may extend downward approximately two to twelve inches (2"–12") from the support bottom 24. Preferably, the rudder 66 extends about three to six inches (3"–6") below the support bottom 24. Further, the rudder 66 is oriented generally parallel with the longitudinal axis 32 of the support section 18 while the rudder 66 is in its "released" position, e.g. when the rudder controller 68 is released by the individual 12.

Similar to the support section 18, the rudder 66 may be can be constructed from a resiliently deformable closed-cell foam or plastic material such as polyurethane or polystyrene, as examples. The rudder 66 can also be made from an inflatable fabric material such as polyurethane rubber or other suitable inflatable materials.

The rudder controller 68 can be made from rope, nylon cord, or another sufficiently strong, relatively inelastic material to permit responsive movement of the rudder 66 by the user 12. The rudder controller 68 is coupled to the rudder 66 as shown in the cross-sectional view of FIG. 6. In the embodiment depicted in FIG. 6, the rudder controller 68 extends through a rudder control coupler 70, with the rudder controller 68 being knotted on each side of the rudder control coupler 70 to secure the rudder controller 68 to the rudder 66. The rudder control coupler 70 can be a grommet with an inside diameter of between about one-quarter inch to one inch (¼"–1"). The rudder control coupler 70 can have an outside diameter from about three-quarters of an inch to two inches (¾"–2"). The rudder controller 68 may be secured to the rudder 66 by other appropriate means such as heat-attachment or by being woven or stitched to the rudder 66.

Additionally, the rudder controller 68 may incorporate the use of one or more rudder control guides 72. FIG. 5 shows an embodiment with two rudder control guides 72 that are typically located at or near the rear support edge 28 of the support section 18. The rudder control guides 72 provide guidance for the rudder controller 68, as well as providing sufficient "triangulation" for the rudder controller 68 in order to sufficiently move the rudder 66 from side to side to steer the device 10. Further, the rudder control guides 72 may extend through entire thickness of the support section 18 to provide a conduit for the rudder controller 68 to extend through the support section 18. Alternatively, and as depicted in FIG. 5, the rudder control guide 72 can be a grommet-like structure secured to the support section 18, through which the rudder controller 68 extends. The rudder controller 68 can also include a rudder control handle 74 for more easily gripping the rudder controller 68.

FIG. 5 illustrates movement of the rudder 66 by moving the rudder controller 68 in a direction that is substantially perpendicular to the longitudinal axis 32 of the support section 18. Moving the rudder controller 68 toward one rudder control guide 72 will cause the rudder 66 to move laterally in an opposite direction. For example, moving the rudder controller 68 in direction A shown on FIG. 5 causes the rudder 66 to move in direction B. As a result, the entire device 10 turns toward the direction generally opposite that of the movement of the rudder controller 68.

Referring to FIGS. 7, 8, 10 and 11, the device 10 may also include one or more skegs 76 that are adapted to guide movement of the support section 18. The skegs 76 are secured to the support bottom 24, and depend generally downward from beneath the support bottom 24. Further, the skegs 76 extend substantially parallel to a longitudinal axis 32 of the support section 18. The skegs 76 help to stabilize the device 10 during use, and provide assistance in turning the device 10, as provided in FIG. 7 which depicts a left turn of the device 10.

Figure 8:
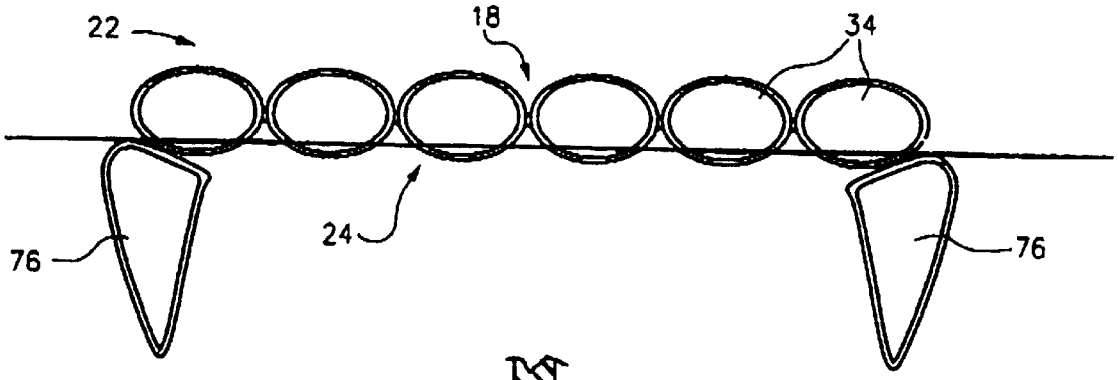
FIG. 8 is a rear view of a second embodiment of two skegs extending generally downwardly from the support section.

The skegs 76 may be formed from a resiliently deformable closed-cell foam or plastic material such as polyurethane or polystyrene, for instance, as depicted in FIG. 7. The skegs 76 can also be made from an inflatable flexible fabric material such as polyurethane rubber or other suitable inflatable materials, as shown in FIG. 8. Both FIGS. 7 and 8 depict a "rudderless" device 10, although the present invention can be configured to include both a rudder 66 as well as one or more skegs 76 as shown in FIG. 10.

While the particular embodiments of the device 10 as illustrated herein are fully capable of obtaining the objects and providing the advantages herein before stated, it is to be understood that it is merely illustrative of the presently preferred embodiments of the invention and that no limitations are intended to the details of construction or design herein shown other than as described in the appended claims.

What is claimed is:

1. A device for moving an individual relative to a surface with the assistance of wind, the device comprising:

a support section that is sized and shaped to support the individual, the support section being substantially comprised of a flexible material, the support section including a support bottom for planing along the surface; and a sail section that is fixed to the support section, the sail section being substantially comprised of a flexible material, the sail section being adapted to catch the wind to move the support section and the individual relative to the surface.

2. The device of claim 1 further including a sail controller that is coupled to the sail section, the sail controller being adapted to be moved by the individual to directionally move the sail section to steer the device.

3. The device of claim 1 wherein at least one of the sections includes one or more inflatable chambers.

4. The device of claim 1 wherein each of the sections includes one or more inflatable chambers.

5. The device of claim 1 wherein the device further comprises at least one skeg, the at least one skeg extending generally downward from beneath the support bottom, the at least one skeg being adapted to guide movement of the support section.

6. The device of claim 5 wherein the at least one skeg is inflatable.

7. The device of claim 1 wherein the sail section further comprises a sail stiffener that is adapted to provide increased rigidity to the sail section while the device is in use by the individual.

8. The device of claim 7 wherein the sail stiffener is inflatable.

9. A device for moving an individual relative to a surface with the assistance of wind, the device comprising:

a support section that is sized and shaped to support the individual, the support section including a support bottom for moving along the surface;

a sail section that is fixed to the support section, the sail section being adapted to catch the wind to move the support section and the individual relative to the surface; and a rudder secured to the support section, the rudder being adapted to be moved by the individual to steer the device.

10. The device of claim 9 wherein the rudder is inflatable.

11. The device of claim 9 wherein the rudder further includes a rudder controller coupled to the rudder, the rudder controller being adapted to be moved by the individual to move the rudder for steering the device.

12. A device for moving an individual relative to a surface with the assistance of wind, the device comprising:

a support section that is sized and shaped to support the individual, the support section including a support bottom for moving along the surface; and a sail section that is fixed to the support section, the sail section including a substantially transparent viewport, the sail section being adapted to catch the wind to move the support section and the individual relative to the surface.

13. The device of claim 12 wherein at least one of the sections includes one or more inflatable chambers.

14. The device of claim 12 wherein the device further comprises at least one skeg, the at least one skeg extending generally downward from beneath the support bottom, the at least one skeg being adapted to guide movement of the support section.

15. The device of claim 12 wherein the sail section further comprises a sail stiffener that is adapted to provide increased rigidity to the sail section while the device is in use by the individual.

16. A device for moving an individual relative to a surface with the assistance of wind, the device comprising:

a support section that is sized and shaped to support the individual, the support section including a support bottom for moving along the surface; and a sail section that is fixed to the support section, the sail section being adapted to catch the wind to move the support section and the individual relative to the surface, wherein the sail section and the support section are substantially formed as a continuous, one-piece structure.

17. A device for moving an individual relative to a surface with the assistance of wind, the device comprising:

a support section that is flexible, the support section being sized and shaped to support the individual, the support section including a support bottom for moving along the surface;

a sail section that is fixed to the support section, the sail section being adapted to catch the wind to move the support section and the individual relative to the surface, the sail section further including a substantially transparent view port that allows the individual to see through the sail section to navigate the device; and a rudder secured to the support section, the rudder being adapted to be moved by the individual to steer the device.

18. The device of claim 17 wherein the rudder further comprises:

a rudder controller that is coupled to the rudder, the rudder controller being adapted to be moved by the individual to move the rudder for steering the device.

19. The device of claim 17 wherein the rudder is inflatable.

20. The device of claim 17 wherein the sail section further comprises a sail controller that is coupled to the sail section, the sail controller being adapted to be moved by the individual to directionally move the sail section to steer the device.

21. The device of claim 17 wherein the support section and the sail section each include one or more inflatable chambers.

22. The device of claim 17 wherein the sections are substantially formed as a continuous, one-piece structure.

23. The device of claim 17 wherein the support section further comprises at least one skeg, the at least one skeg extending generally downward from beneath the support bottom, the at least one skeg extending substantially parallel to a longitudinal axis of the support section, whereby the at least one skeg is adapted to guide movement of the support section.

24. The device of claim 23 wherein the at least one skeg is inflatable.

25. A device for moving an individual relative to a surface with the assistance of wind, the device comprising:

a support section that is flexible, and sized and shaped to support the individual, the support section including a support bottom for moving along the surface;

a sail section that is fixed to the support section, the sail section being adapted to catch the wind to move the support section and the individual relative to the surface, the sail section including a substantially transparent view port to allow the individual to see through the sail section to navigate the device;

a sail controller which is connected to the sail section, the sail controller being adapted to be moved by the individual to directionally move the sail section to steer the device;

a rudder secured to the support section;

a rudder control guide that is coupled to the support section; and a rudder controller that extends through the rudder control guide, the rudder controller being connected to the rudder, the rudder controller being adapted to be moved by the individual to move the rudder for steering the device.

26. The device of claim 25 wherein the rudder is inflatable.

27. The device of claim 25 wherein at least one of the sections includes one or more inflatable chambers.

28. The device of claim 25 wherein each of the sections includes one or more inflatable chambers.

29. The device of claim 25 wherein the sections are substantially formed as a continuous, one-piece structure.

30. The device of claim 25 wherein the support section further comprises at least one skeg, the at least one skeg extending generally downward from beneath the support bottom, the at least one skeg extending substantially parallel to a longitudinal axis of the support section, whereby the at least one skeg is adapted to guide movement of the support section.

31. The device of claim 30 wherein the at least one skeg is inflatable.

* * * * *